US006550221B1

(12) United States Patent
Neri

(10) Patent No.: US 6,550,221 B1
(45) Date of Patent: Apr. 22, 2003

(54) METHOD AND A MACHINE FOR BANDING GROUPS OF SHEETS, IN PARTICULAR BANKNOTES

(75) Inventor: Armando Neri, Bologna (IT)

(73) Assignee: Currency Systems International, Irving, TX (US)

( * ) Notice: Subject to any disclaimer, the term of this patent is extended or adjusted under 35 U.S.C. 154(b) by 140 days.

(21) Appl. No.: 09/686,801

(22) Filed: Oct. 12, 2000

(30) Foreign Application Priority Data

Oct. 26, 1999 (IT) ..... B099A0572

(51) Int. Cl.[7] ..... B65B 13/02; B65B 13/04

(52) U.S. Cl. ..... 53/399; 53/466; 53/586; 53/228; 53/375.9; 53/447; 53/540; 100/17

(58) Field of Search ..... 53/399, 466, 586, 53/228, 375.9, 447, 540; 100/17

(56) References Cited

U.S. PATENT DOCUMENTS

| | | | | | |
|---|---|---|---|---|---|
| 2,885,839 | A | * | 5/1959 | Weiss | 100/17 |
| 2,894,363 | A | * | 7/1959 | Voogd | 192/56.2 |
| 3,991,542 | A | * | 11/1976 | White et al. | 53/228 |
| 4,012,890 | A | * | 3/1977 | Bauer | 53/228 |
| 4,075,815 | A | * | 2/1978 | Carver et al. | 53/228 |
| 4,271,655 | A | * | 6/1981 | Nagayoshi | 53/201 |
| 4,276,736 | A | * | 7/1981 | Haberstroh et al. | 53/399 |
| 4,498,381 | A | * | 2/1985 | Convey, Jr. | 100/100 |
| 4,558,557 | A | * | 12/1985 | Kuehfuss | 53/506 |
| 4,617,784 | A | * | 10/1986 | Golicz et al. | 53/228 |
| 6,085,487 | A | * | 7/2000 | De Vlaam | 100/17 |
| 6,282,868 | B1 | * | 9/2001 | Vlaam | 53/228 |

FOREIGN PATENT DOCUMENTS

| | | |
|---|---|---|
| DE | 1088868 | 9/1960 |
| DE | 1118688 | 11/1961 |

* cited by examiner

*Primary Examiner*—Rinaldi I. Rada
*Assistant Examiner*—Hemant M. Desai
(74) *Attorney, Agent, or Firm*—Colin P. Cahoon; Carstens, Yee & Cahoon, LLP

(57) ABSTRACT

Bundles of banknotes are directed singly and in succession along an infeed duct toward a station located at the top of a channel, where they are formed into a block; the channel functions as a guide along which the block is conveyed by means of a companion element, following a predetermined feed path, at the same time as a continuous strip of banding material is fed along a path transverse to this same path. The leading end of the strip is taken up and restrained by a gripper device, and as the block progresses along the channel, the strip is intercepted and forced to wrap around three faces of the block, assuming a U shape, whereupon the leading end is flattened against the remaining face and a further portion of the strip is drawn by a diverter mechanism into overlapping contact with the leading end. The strip is then cut by a knife, leaving a discrete length of which the ends are joined by a heat seal bit to form a band around the block.

24 Claims, 9 Drawing Sheets

1
9
13
P
8
6a
5
17
6d
15
A
6
47a
6b
14
16
28
47
17a
26
45
18
19
10
F2
B
35a
36a
27
30
31a
11
36
F1
33
Q
40
20
35
C
32
21
24
29
31
39
38
45
49a
48
49
44
18a
43a
50
43
51
R
42
18b
41
12
46
45a
46a
7

1
9
13
P
8
6a
6
5
17
6d
A
18a
18b
10
15
17a
16
14
47a
18
28
47
66
11
26
45
55
19
24
F2
34
27
B
30
49a
3
40
F1
37
36
20
33
Q
39b
21
39
39a
22
35
32
23a
23
25
29
38
27a
31
48
19
D
3
49
45
50
4
43a
51
43
41
42
44
12
R
46
46a
45a
7

1
13
P
8
9
17
6d
15
18
6a
A
14
47a
6
47
28
10
26
27a
16
20a
17a
27
24
11
B
29
49a
35a
36a
20
30
C
36
24a
33
Q
40
3
39b
22
39
21
49
39a
23
23a
25
25a
31
38
32
48
56
D
2
45
6
51
18a
5
50
R
4
12
43
44
41
46a
46
42
43a
45a
7

METHOD AND A MACHINE FOR BANDING GROUPS OF SHEETS, IN PARTICULAR BANKNOTES

BACKGROUND OF THE INVENTION

The present invention relates to a method of banding groups of sheets, in particular banknotes.

The invention finds application to advantage in machines by which banknotes are ordered into groups and transferred to a strapper/bander by which at least one band is looped around each single group of notes and made secure.

It is well known that banks need to move notable amounts of paper money around on a daily basis, whether central banks by which new banknotes are issued, or trading banks through which the notes are circulated. To this end, banknotes are first sorted into groups and then placed for the purposes of transportation into relative bags or cassettes.

To ensure they can be ordered and transported without the risk of breaking up and to prevent their being tampered with, the groups are secured with bands serving to keep the notes together and minimize opportunities for robbery or pilfering.

Generally speaking, banknotes are fed singly and in succession into machines of the aforesaid type and, having been examined and sorted according to denomination and/or type, are directed separately toward the outlets of respective channels along which the groups are formed.

In this way stacks of single banknotes are formed at each of the outlets, and as the single notes are accumulated and ordered in predetermined numbers, each stack is taken up and transferred to a station at which it will be suitably strapped or banded.

Alternatively, still with machines of the type in question, notes that have been checked and sorted beforehand can be fed into the formation channels already bundled and strapped or banded, so that the stacks which form at the outlet of each channel are stacks of bundles rather than of single notes, and these same stacks of bundles are taken up similarly and transferred to the aforementioned strapping or banding station.

For the reasons mentioned above, the strapping or banding operation must be fast and accurate and ensure an end product characterized by strength and quality. In the case of central banks, especially, newly printed notes must be handled with extreme care in order to avoid any accidental damage that might prevent their being issued.

The prior art embraces machines for strapping and banding banknotes comprising a feed unit by means of which a continuous strip of material decoiling from a respective roll is cast toward a gripper and placer device that moves along a path following the periphery of the group of notes, offering the strip to one side of the group after another and keeping the material tensioned against the notes until the point of engaging further devices which secure and cut the strip, thus bringing the strapping/banding operation to completion.

It will be evident that the solution of utilizing an active mechanism to place and tension the strip around the stack of notes is liable to prejudice a correct execution of the wrapping step, especially at the edges of the stack, where an incorrectly controlled tension can have the effect of damaging and/or displacing the notes, should the strip be overtensioned, or on the other hand of rendering the strapping or banding action ineffective if the strip is too slack.

The method in question has been found especially unsuitable, especially with regard to correct and uniform tensioning of the strip, when adopted for strapping or banding notably thick or tall stacks consisting in a number of notes greater than that of a standard bundle, or in a plurality of bundles stacked together.

Another drawback of such machines is encountered during the operation of making the strip secure, accomplished generally by overlapping the ends and sealing them together. The tensioned state of the strip tends to render the operation difficult.

Accordingly, and for the reasons outlined above, machines of the type in question are limited in terms of operating capacity, lacking in precision and not altogether reliable.

The object of the present invention is to provide a machine for banding groups of sheets, banknotes in particular, such as will apply the bands swiftly and accurately and produce an end result assuring strength and quality.

A further object of the invention is to provide a machine capable of strapping or banding groups of single banknotes and groups of bundled banknotes with equal ease.

SUMMARY OF THE INVENTION

The stated object is realized according to the present invention in a method for securing at least one band of strip material around a substantially parallelepiped block of sheets, in particular banknotes, which comprises the steps of causing at least one continuous strip decoiling from a roll to advance along a first predetermined path through the agency of first feed means; restraining one end of the continuous strip through the agency of gripping means designed to interact with a leading portion of the strip that coincides with a first end of the band; causing the block of sheets, through the agency of second feed means, to advance along a second path transversely to the first path in such a way as to enter into contact with the strip and, continuing to advance along the second path, cause the strip to decoil further from the roll and bend to a "U" profile; engaging the leading portion of the strip through the agency of bending means and flattening it against a face of the block positioned rearwardmost relative to the direction followed along the second path; drawing the strip into overlapping contact with the first end of the band, through the agency of diverter means located on the side of the second path opposite to the bending means; cutting the strip at the overlap through the agency of cutter means, to define a second end of the band; securing the second end of the band to the first end through the agency of sealing means.

The stated object is realized similarly according to the invention in a machine for securing at least one band of strip material around a substantially parallelepiped block of sheets, in particular banknotes, comprising first feed means by which at least one continuous strip decoiling from a roll is caused to advance along a first predetermined path; a channel serving to guide the block of sheets and establishing a second predetermined path transverse to the first path; gripping means positioned externally of the channel and in such a way as to interact with a leading portion of the continuous strip and restrain one end of the selfsame strip; second feed means by which a block of sheets is made to advance along the channel and enter into contact with the strip; bending means operating in conjunction with the gripping means, by which the leading portion of the strip is flattened against a face of the block positioned rearwardmost relative to a direction followed along the second path; diverter means located on the side of the channel opposite to the bending means, by which the strip is engaged and drawn into overlapping contact with at least a part of the leading portion; cutter means by which the strip is severed at the overlap to define a second end of the band; sealing means by which the second end of the band is secured to the first end.

BRIEF DESCRIPTION OF THE DRAWINGS

The invention will now be described in detail, by way of example, with the aid of the accompanying drawings, in which:

FIGS. 2 to 8 illustrate a portion of the machine as in FIGS. 1, 4 and 9, viewed schematically in a side elevation and seen in a succession of operating steps;

DESCRIPTION OF THE PREFERRED EMBODIMENTS

Figure 4:
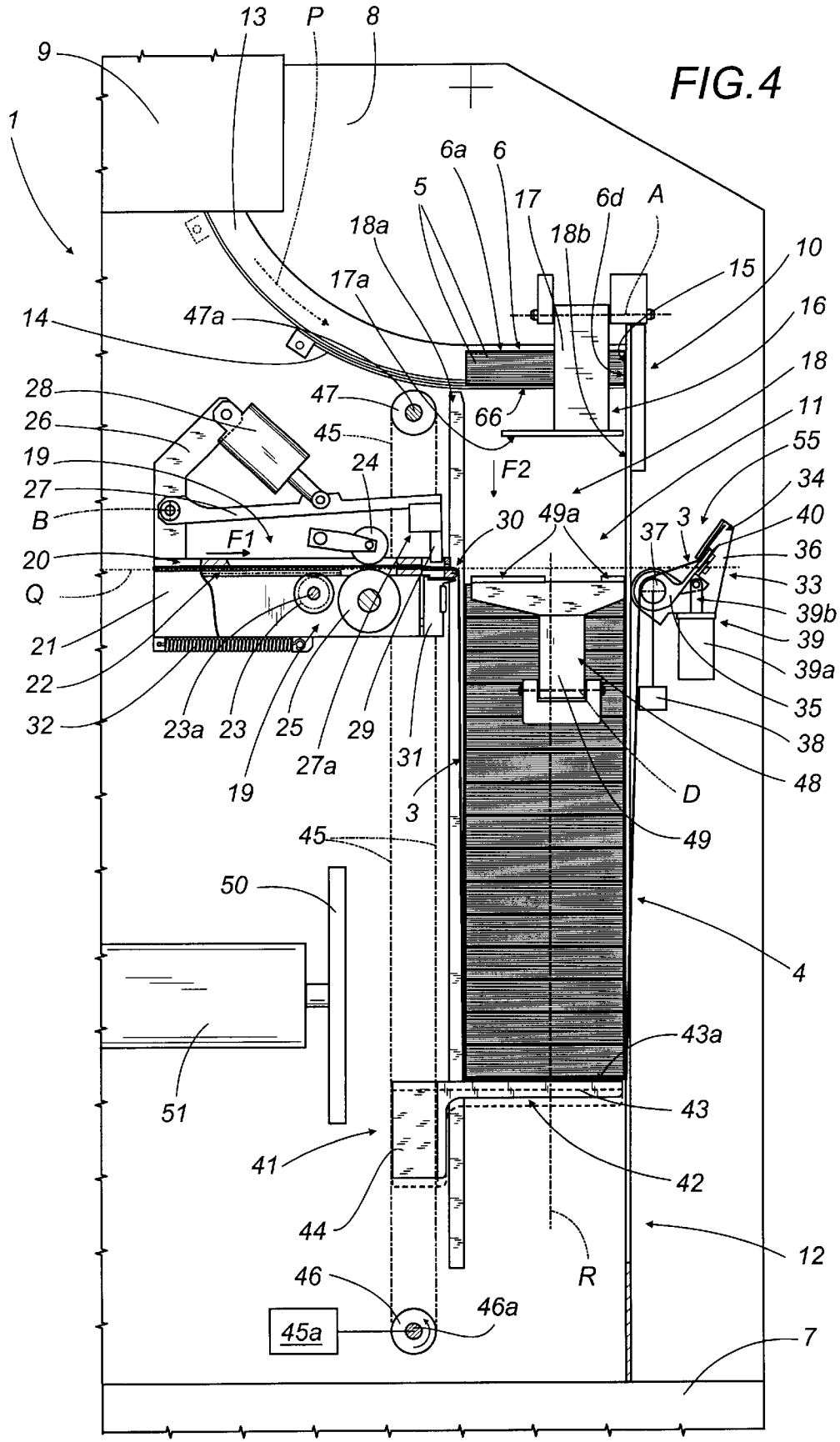

With reference to the accompanying drawings and to FIG. 4 in particular, 1 denotes a portion of a machine, in its entirety, by which bands 2 of a strip material 3 are secured around blocks 4 of sheets, one block 4 consisting in an ordered stack either of single banknotes 5, or alternatively of banknotes 5 sorted previously into a plurality of bundles 6, as in the example illustrated.

The machine 1 comprises a frame 7 supporting a vertical bulkhead 8. The vertical bulkhead 8 in turn supports a temporary storage area 9 indicated fragmentarily and schematically in the drawings, being of familiar embodiment, where the bundles 6 are allowed to gather, also a station 10 at which the block 4 is formed, a banding station 11 at which the strip 3 is secured around the block 4, and an outfeed station 12 from which the finished block 4 emerges with at least one band 2.

Figure 1:
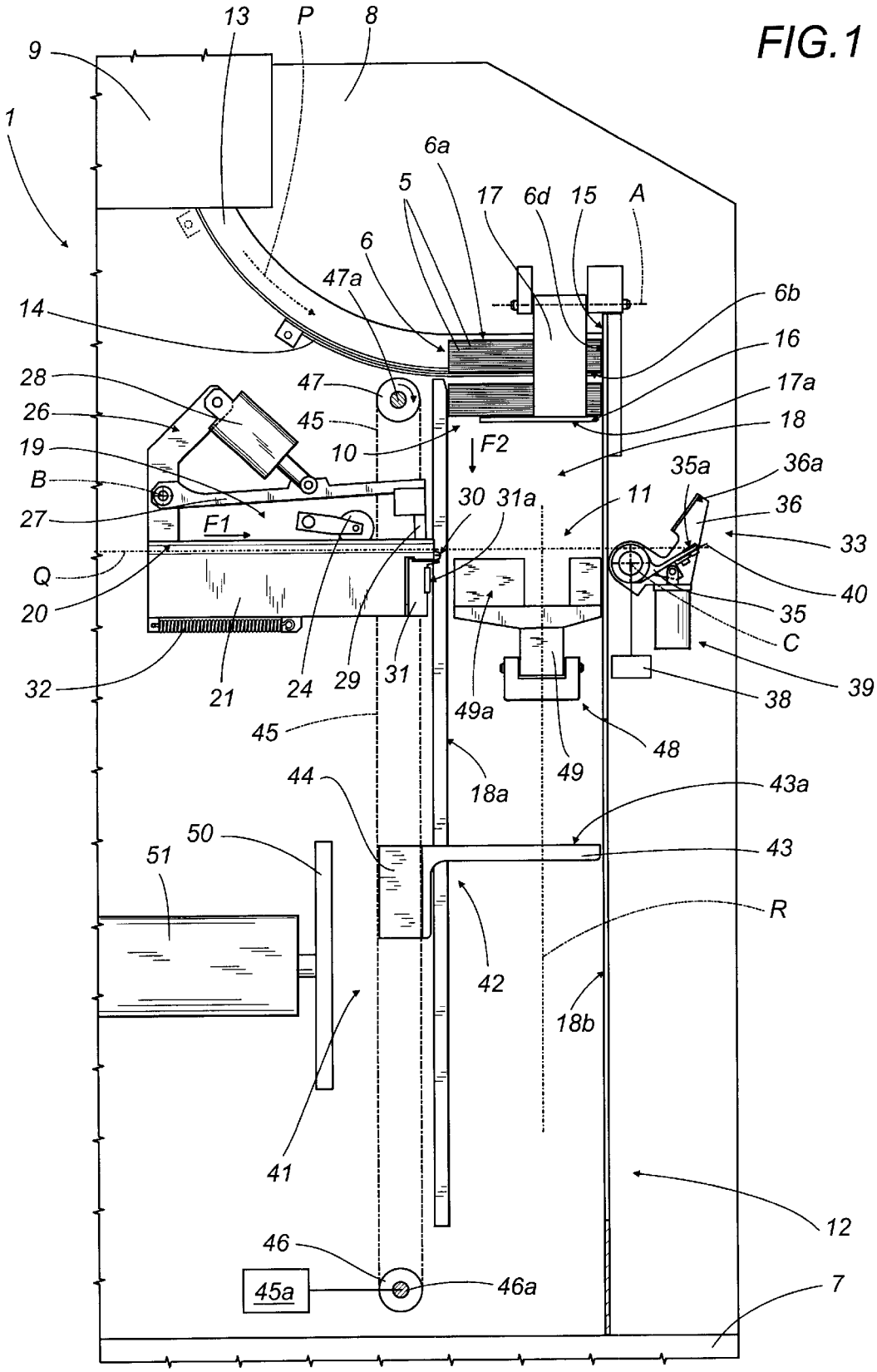
FIGS. 1, 4 and 9 illustrate a machine embodied according to the present invention for strapping or banding groups of banknotes, viewed schematically in a side elevation and seen in a succession of operating steps.
Figure 2:
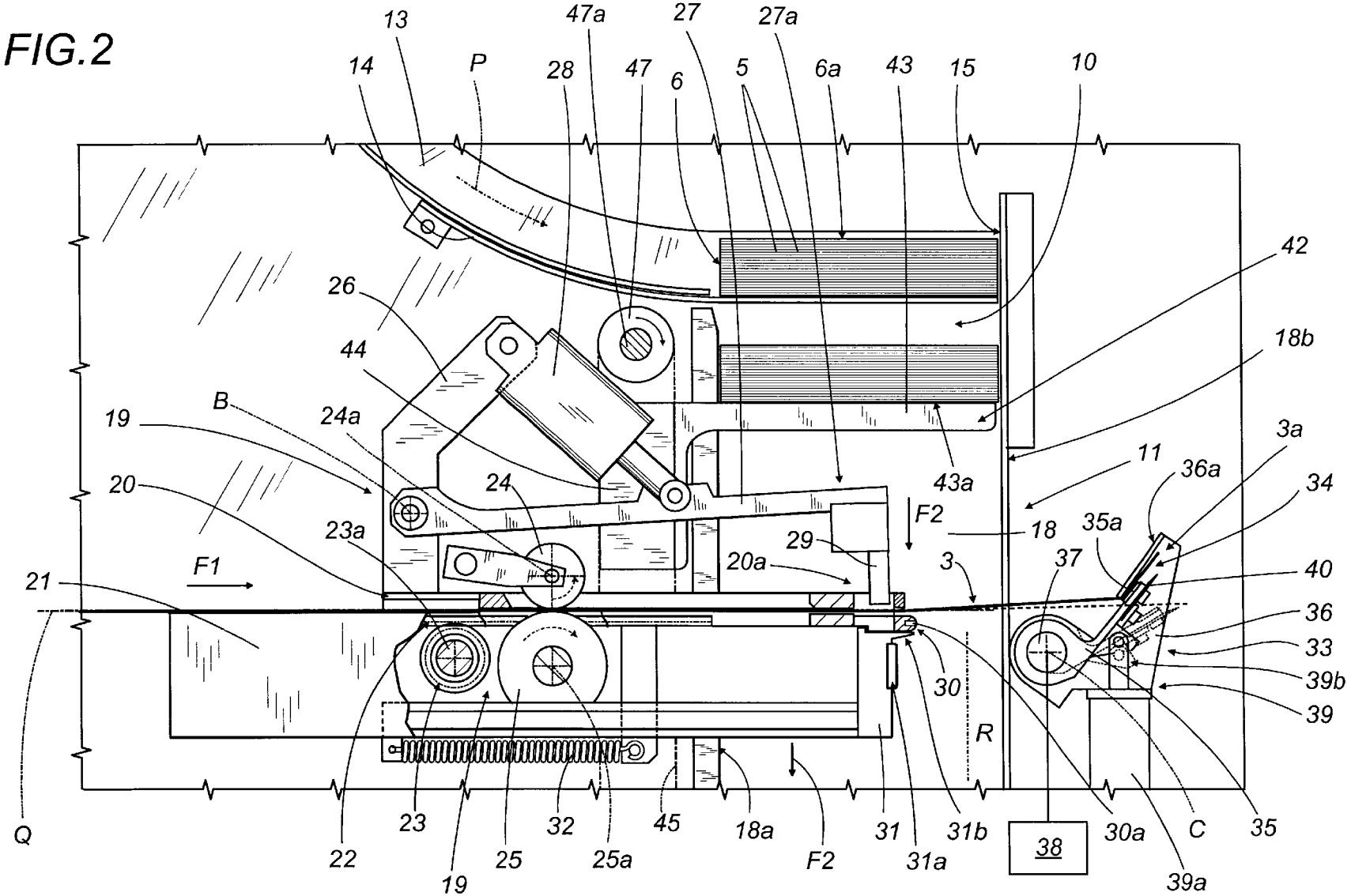
Figure 3:
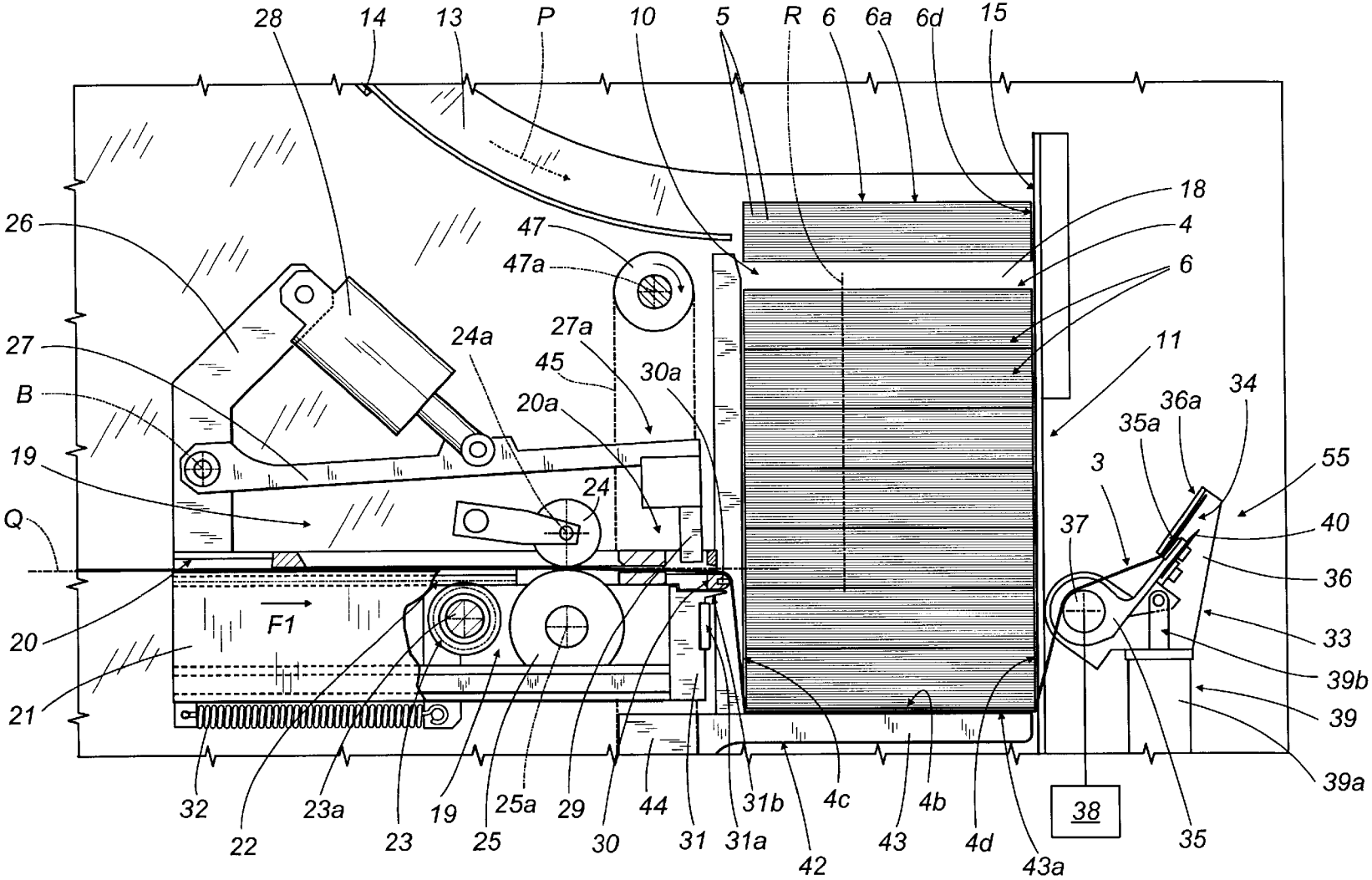

The temporary storage area 9 holding bundles 6 of banknotes 5 is placed in the topmost part of the machine 1 from where the bundles 6 are fed toward the forming station 10 by way of an infeed duct 13, extending along a feed path denoted P, of which the end nearest the forming station 10 is equipped with a shutter 14 capable of movement between a position in which the duct 13 is closed, as in FIGS. 1, 2, 4 and 9, and a position in which the duct 13 is open as indicated in FIG. 3.

The station 10 at which the blocks 4 are formed incorporates a barrier 15 positioned to halt the bundles 6 and marking the end of the duct 13, also a pair of support elements 16 located one on either side of the duct relative to the plane of FIG. 1, each embodied as an arm 17 appearing substantially L-shaped in section and offering a flat contact surface 17*a* to each bundle 6 as it reaches the end of the infeed duct 13.

The arms 17 are rotatable about respective axes A between a first position in which a bundle 6 is restrained, and a second open position in which the surfaces 17*a* are distanced from the bundle 6 held hitherto.

The aforementioned shutter 14 connects the end part of the infeed duct 13 conveying the bundles 6 with a vertical channel 18 of which the function is to guide the movement of the block 4 accumulating in the forming station 10.

The strip 3, a continuous material made to decoil conventionally from a roll (not illustrated), is directed through the agency of first feed means 19 along a first substantially rectilinear path Q that intersects the channel 18 transversely at the level of the banding station 11. The block 4 of bundles 6 is caused in turn to advance along the channel 18 following a second feed path R extending parallel to the selfsame channel.

The channel 18, considered positionally relative to a direction F1 followed by the strip 3 along the first path Q, comprises a rear vertical wall 18*a* and a front vertical wall 18*b*.

Considered in relation to a direction F2 followed along the second path R, the block 4 of bundles 6 presents a rear face 4*a* and a front face 4*b*, also two mutually parallel side faces 4*c* and 4*d* disposed perpendicular to the first path Q.

The first feed means 19 comprise a first slide 20 located in the vicinity of the banding station 11 and capable of movement along the first rectilinear path Q on a relative track 21 between a retracted first position shown in FIGS. 1, 2, 4, 8 and 9, remote from the channel 18, and an extended second position shown in FIGS. 2, 5, 6 and 7, in which its forwardmost end 20*a* occupies the channel 18.

The slide 20 comprises a rack 22 engaged in mesh with a pinion 23 mounted to a shaft 23*a* that is carried by the bulkhead 8 and set in rotation by a motor of conventional type (not illustrated) in such a way as to reciprocate the slide 20 between the first and second positions.

The first feed means 19 further comprise a pair of pinch rolls 24 and 25 mounted to the slide 20 and rotatable about respective axes 24*a* and 25*a*. The two rolls 24 and 25, of which at least one 25 is power driven by means of conventional embodiment (not illustrated), are disposed tangentially one to the other between the roll and the station 11, one in contact with either side of the strip 3, in such a way as to draw the strip 3 along the first feed path Q.

The slide 20 comprises an upright bracket 26 at the end remote from the forwardmost end 20*a*, also an arm 27 anchored pivotably to an intermediate part of the bracket and capable of angular movement in relation to the bracket about an axis denoted B, induced by an actuator 28 anchored similarly to the free top end of the bracket 26. The free end 27*a* of the arm 27 directed toward the channel 18 carries a heat seal bit 29. The actuator 28 serves to rotate the arm 27 between a raised at-rest position (see FIGS. 5 and 6), and a lowered operating position (see FIG. 7) in which the bit 29 is brought into contact with the strip 3 to effect a seal.

Also associated with the first slide 20, at the aforementioned forwardmost end 20*a*, is a diverter element 30 embodied in such a way as to displace the strip 3 when the slide 20 is caused to move forward from the retracted first position.

The slide 20 further comprises a clamp element 31 mounted translatably to the underside and connected dynamically by way of a spring 32, through which the movement of the slide 20 is transmitted to the selfsame element 31.

The end of the clamp element 31 directed toward the channel 18 presents a surface 31*a* positioned to enter into contact with the block 4 and thus pin the strip 3 against the corresponding side face 4*c*, also a lip 31*b* positioned to engage the corner edge of the block 4 along which the rear face 4*a* meets the side face 4*c*.

The banding station 11 also comprises a gripper device 33 positioned on the side of the second feed path R opposite from the first feed means 19, of which the function is to interact with a leading portion 34 of the strip 3 and restrain the relative leading end 3*a*.

Referring in particular to FIGS. 2, 3, 5 and 8, the gripper device 33 comprises a first jaw 35 and a second jaw 36 mounted coaxially to a shaft 37 supported by the bulkhead 8 and centered on an axis of rotation denoted C, each affording a respective flat surface 35*a* and 36*a* by which the strip 3 is engaged. The jaws 35 and 36 rotate as one with the shaft 37, which is coupled to and driven by a motor of conventional embodiment indicated schematically as a block 38, and can also be rotated one relative to another through the agency of an actuator 39 of which the body 39*a* is rigidly associated with the second jaw 36 and the rod connected in such a way as to rotate the first jaw 35 about the shaft 37 toward and away from the second jaw 36.

Figure 6:
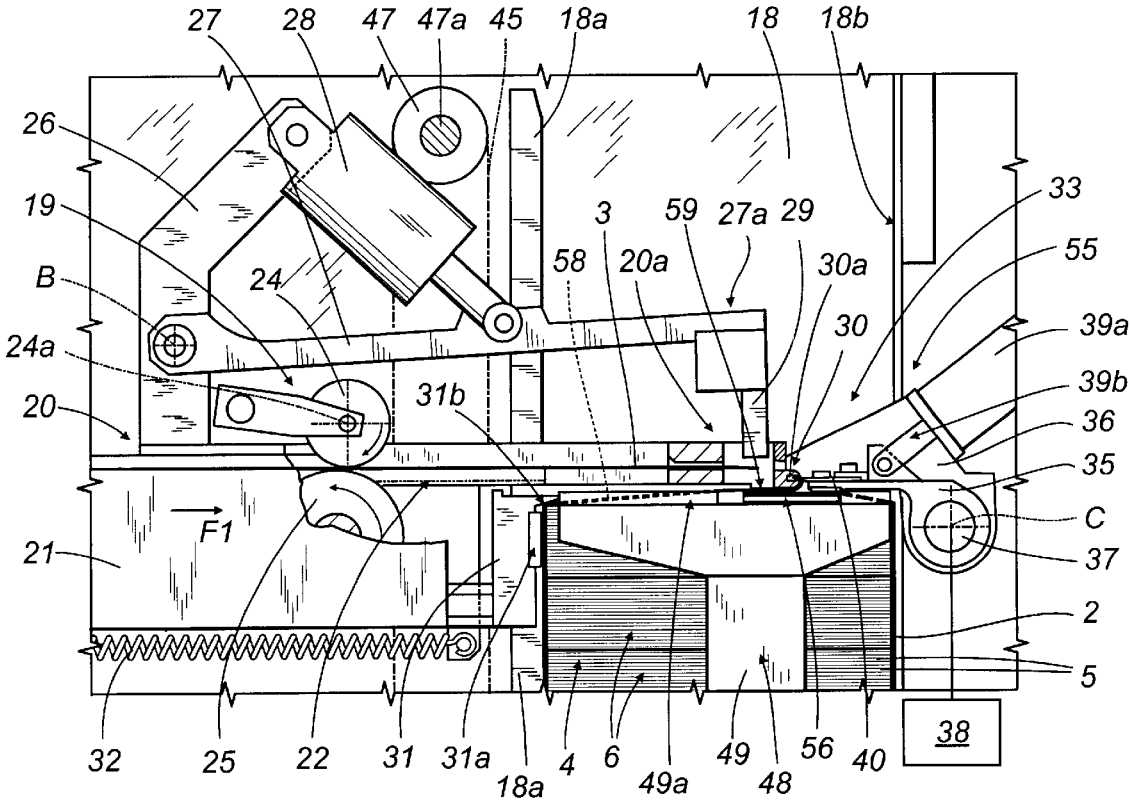

The first jaw 35 of the gripper device 33 carries a knife 40 positioned so as to locate in a slot 30*a* afforded by the diverter element 30, which extends substantially parallel to the axis C of rotation and is shaped to admit the knife 40, causing the strip 3 to be cut as illustrated in FIG. 6.

The machine also comprises second feed means 41 operating in the channel 18, including a companion element 42 by which the block 4 of sheets is caused to advance along the second path R.

The companion element 42 comprises cantilevered members 43, each of which affording a platform 43*a* offered in direct contact to the front face 4*b* of the block 4.

Each of the members 43 is rigidly associated with a second slide 44 capable of movement on a track (not shown) extending vertically along the rear wall 18*a* of the channel 18.

The second slide 44 is set in motion along the second path R by transmission means 45 consisting in a belt looped around a live wheel 46 positioned at the bottom end of the channel 18, driven by a relative motor 45*a*, and a loose wheel 47 positioned at the top end of the channel 18; the two wheels 46 and 47 are mounted to respective shafts 46*a* and 47*a* carried by the bulkhead 8.

The block 4 of bundled banknotes 5 is compacted by a device 48 located near the banding station 11; the device 48 in question functions substantially as a gripper, comprising a pair of first reaction arms 49 placed on either side of the second path R (one only is visible in the drawings), and a second arm provided by the companion element 42.

Each of the two first reaction arms 49 presents a substantially L-shaped outline and comprises a flat surface 49*a* offered in direct contact to the rear face 4*a* of the block 4, pivotable about an axis D is lying parallel to the first path Q between a first operating position of contact with the block 4 and a second at-rest position distanced from the second feed path R, in which the block 4 of banknotes 5 is able to advance along the path R.

50 denotes a push rod 50 located in the vicinity of the outfeed station 12 where the block 4 emerges from the channel 18, which is caused by a relative actuator 51 to reciprocate between a first at-rest position, distanced from the channel 18, and a second operating position assumed when the block 4 is pushed out of the channel 18.

Figure 10:
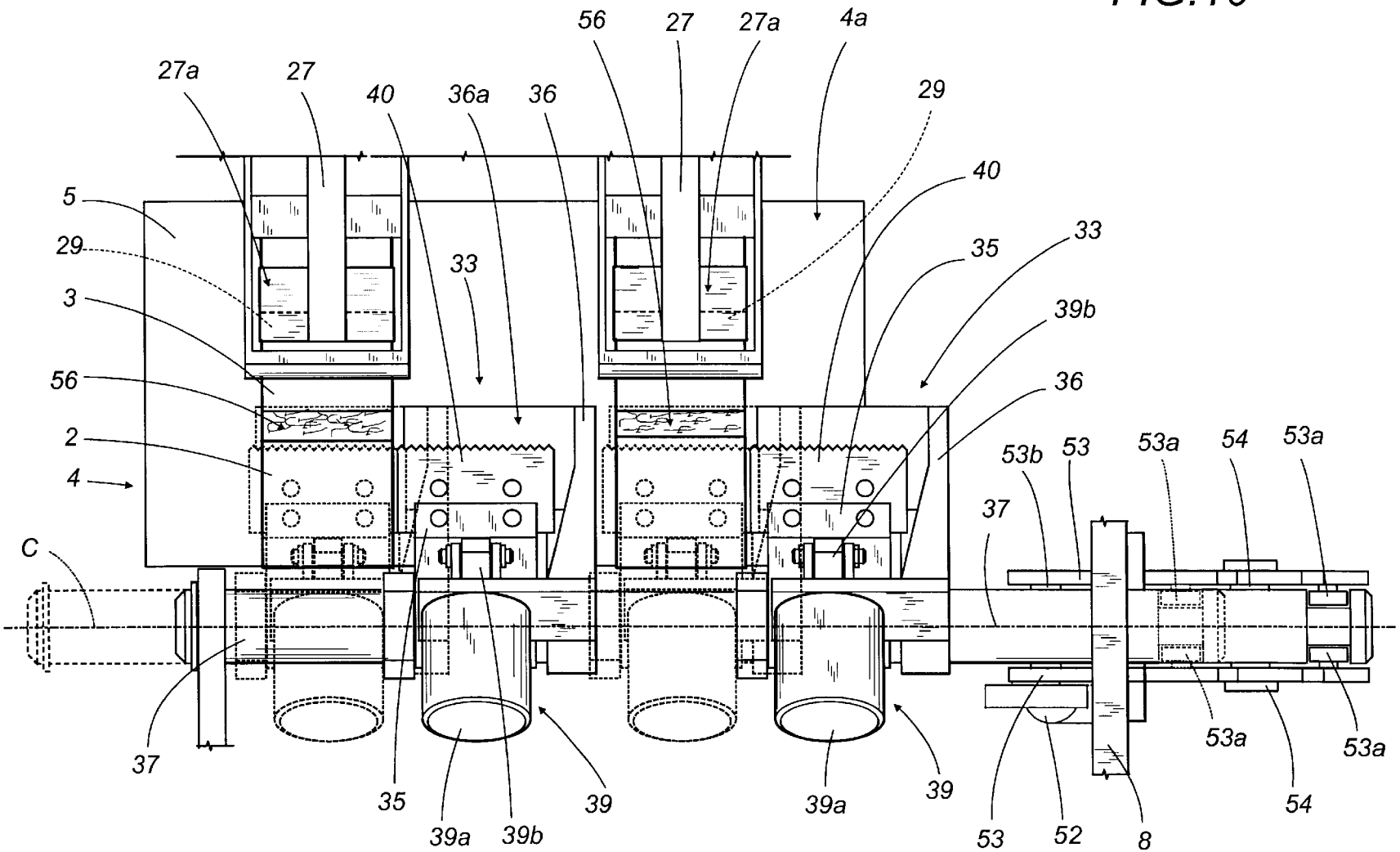
FIGS. 10 and 11 show a detail of the machine as in FIGS. 1, 4 and 9, viewed respectively in plan from above and in elevation from the front, with certain parts omitted for clarity, and illustrating a succession of operating steps.
Figure 11:
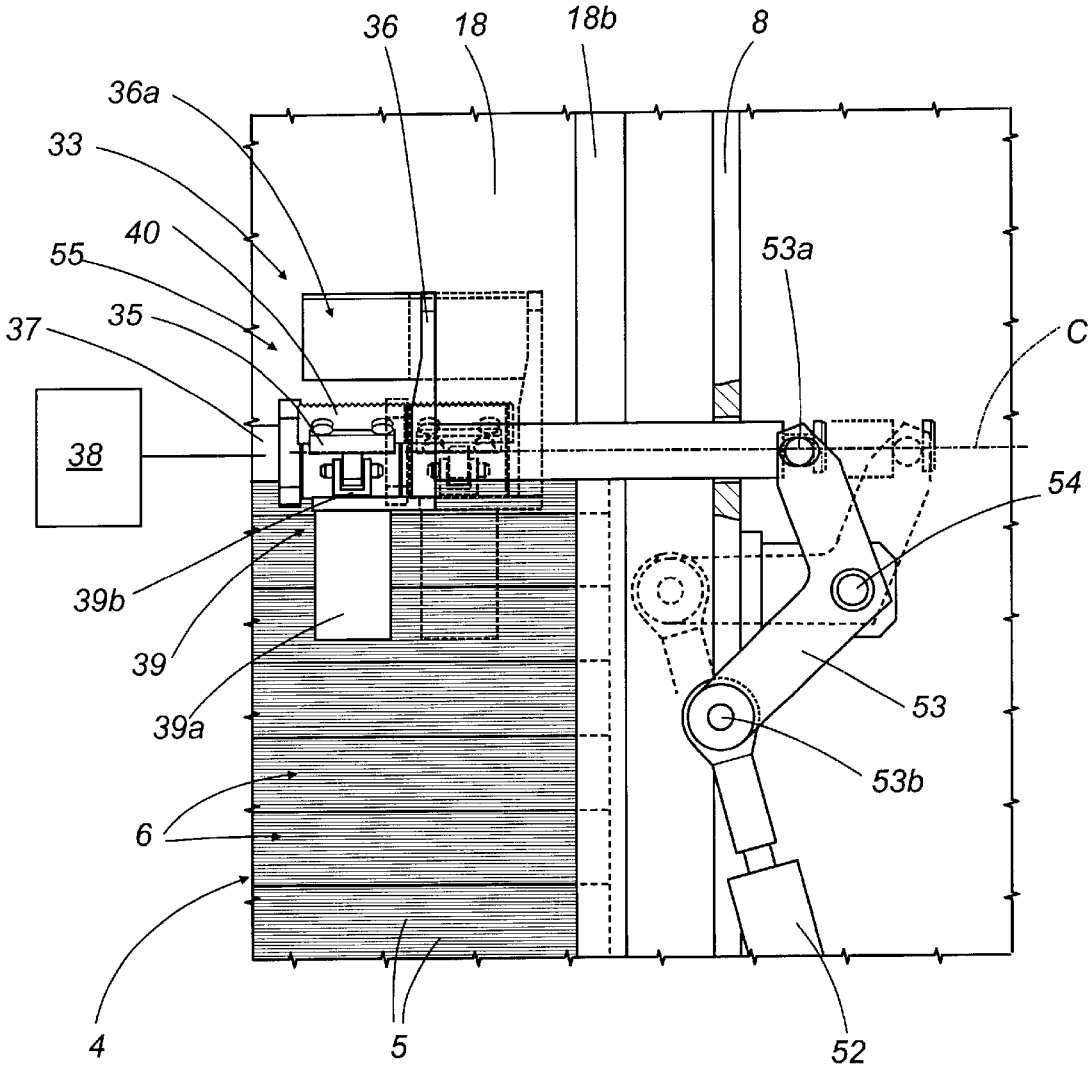

As discernible from FIG. 10 and FIG. 11, the shaft 37 to which the jaws 35 and 36 of the gripper device 33 are mounted is capable also of axial motion brought about by an actuator 52 between a first position, in which the device 33 engages the strip 3 (shown by phantom lines in FIG. 10), and a second position in which the device 33 releases the strip 3 (solid lines in FIG. 10).

The actuator 52 is connected to the shaft 37 by way of a bellcrank 53 mounted to a fixed pivot 54 and coupled articulatedly with the shaft 37 and the actuator 52 respectively by two further pivots 53*a* and 53*b*.

In operation, with reference to the foregoing and to the illustrations of the accompanying drawings, groups or bundles 6 of banknotes 5 gathering in the temporary storage area 9 are fed by gravity down the infeed duct 13 toward the forming station 10 at predetermined intervals, along the relative path P. The passage of the bundle 6 along the duct will be halted by the obstacle offered to one side face 6*d* by the barrier 15.

The shutter 14 is incorporated into the final stretch of the duct 13 along which the bundles 6 proceed, to the end that in the closed position of FIG. 1 the bundle 6 can be effectively prevented by the shutter 14 from leaving the duct 13 and at the same time supported by the selfsame shutter up to the moment of locating against the barrier 15.

In like manner to the block 4, and with reference to the direction F2 followed by the block 4 along the second feed path R, the bundle 6 presents a rear face 6*a* and a front face 6*b*, mutually opposed. The shutter 14 opens subsequently and allows the bundle 6 to drop freely onto the flat surfaces 17*a* of the support elements 16, which will be occupying the aforementioned first position with the selfsame surfaces 17*a* lying substantially in a common plane.

The arms 17 are able to rotate about their axes A and thus to assume the open position in which the flat surfaces 17*a* no longer disallow the passage of the bundle 6, which thus becomes free to advance down the channel 18 and along the feed path R.

Once free of the support elements 16 as indicated in FIG. 2, the bundle 6 is able to drop under its own weight onto the companion element 42, settling on the two platforms 43*a* afforded by the respective members 43.

The companion element 42 is now set in motion down the channel 18 which, it will be remembered, stands substantially vertical and determines the second feed path R followed by the block 4. The channel 18 is compassed by the aforementioned rear and front vertical walls 18*a* and 18*b*, disposed respectively upstream and downstream in the feed direction F1 of the first rectilinear path Q, as well as by side panels (not illustrated) located on opposite sides of the bundles 6, parallel to the viewing plane of FIG. 2. The barrier 15 consists effectively in an extension of the front vertical wall 18*b*, located beyond the longitudinal compass of the channel 18.

The movement of the companion element 42 takes in a first receiving step, identifiable as a plurality of receiving positions assumed by the element 42 in the upper part of the channel 18 (FIGS. 2 and 3) during which the bundles 6 released from the infeed duct 13 are deposited one on top of another on the members 43 to form an ordered stack that becomes a block 4, also a second operating position assumed in the central part of the channel 18, in which the strip 3 is secured around the block 4 (FIG. 4), and a third outfeed position assumed at the bottom of the channel 18 (FIG. 9), in which the block 4 is ejected from the channel 18 by the push rod 50.

In the course of the receiving step, as indicated in FIGS. 2 and 3, the companion element 42 moves intermittently in the direction denoted F2 along the second feed path R in such a way as to advance, each time a new bundle 6 of banknotes 5 is added to the forming stack, through a distance substantially equal to the thickness of the single bundle 6.

In this way the rear face 6*a* of the last bundle 6 added to the stack will always be positioned at the same optimum distance from the shutter 14. It is in fact important that the distance in question should not be too great, since an excessively long fall of the bundle 6 when released from the duct 13 could jeopardize the correct alignment of the bundle 6 with others of the block already stacked beneath.

For this very reason, the support elements 16 are proportioned in such a manner as to accommodate no more than one or two bundles 6 received from the infeed duct 13. If the arms 17 of the elements 16 were made longer, they would be able to accommodate a greater number of bundles 6 while waiting for the companion element 16 to complete the handling of the previous block 4, and this undeniably would be advantageous in speeding up the banding cycle; unfortunately, the distance covered by the first bundle 6 in this instance when dropping onto the flat surfaces 17*a* of the support element 16 would be too great, and liable to jeopardize its correct alignment with the following bundles 6.

Observing FIG. 2 it will be seen that while the companion element 42 is in the receiving position, the step of advancing the strip 3 along the first rectilinear path Q also takes place. The peripheral surfaces of the contrarotating pinch rolls 24 and 25 possess a high coefficient of friction, and the high angular velocity of the rolls will ensure that the leading portion 34 of the strip 3 is propelled forward along the first feed path Q in the relative direction F1 at a velocity sufficient to ensure its timely arrival at the gripper device 33, located externally of the channel 18 in alignment with the banding station 11.

The strip 3 is also guided along the first path by the first slide 20, of which the functions include accompanying the strip 3 in its movement toward the gripper device 33 by traveling likewise along the first path Q. The movement in question is brought about by rotation of the pinion 23 engaged in meshing contact with the rack 22 afforded by the slide 20.

The pinch rolls 24 and 25 cease rotating as soon as the leading portion 34 of the strip 3 reaches the gripper device 33.

At the moment the strip 3 is directed forward, the flat surface 35*a* of the first jaw 35 will be positioned substantially tangential to the first path Q as indicated by phantom lines in FIG. 2; as the pinch rolls 24 and 25 cease rotation, the leading portion 34 of the strip 3 will be disposed facing the flat surface 35*a* and lying outside the dimensional compass of the channel 18. From this position, identifiable as the open position of the jaws, the first jaw 35 is caused by the actuator 39 to rotate counterclockwise as viewed in FIG. 2, relative to the second jaw 36. The body 39*a* of the actuator 39 is rigidly associated with the second jaw 36, whereas the rod 39*b* is connected to the first jaw 35 and thus brings about its rotation. During this same rotation, the flat surface 35*a* of the jaw 35 interferes with the strip 3, displacing it and pushing it against the flat surface 36*a* of the second jaw 36. The position in which the flat surfaces 35*a* and 36*a* are brought ultimately into mutual contact with the strip 3 interposed between them is identifiable as the closed position of the jaws 35 and 36, in which the strip 3 is restrained by the gripper device 33.

The surfaces 35*a* and 36*a* will either be fitted with rubber inserts, or exhibit surfaces machined in such a way as to ensure a high coefficient of friction and thus maximize the grip on the strip 3.

Once the strip 3 is held by the gripper device 33 the first slide 20 will begin retracting, as the rack 22 is driven by the pinion 23 now rotating in the direction opposite to the direction mentioned previously, and moves in the direction opposite to that of the arrow F1 so as to regain its original position outside the dimensional compass of the channel 18 occupied by the bundles 6 (FIG. 3).

The strip 3 is thus placed across the channel 18, tensioned between the roll on the one hand and the jaws 35 and 36 of the gripper device 33, which restrains the leading portion 34, on the other.

With the strip 3 in this configuration and the bundles 6 continuing to accumulate on the companion element 42 after dropping from the infeed duct 13, the companion element 42 itself in advancing along the second path R will ultimately impinge on the strip 3 as illustrated in FIG. 3.

Once the bundles 6 accumulating on the companion element 42 have collected in the requisite number for the formation of a block 4, the shutter 14 closes so that no more bundles 6 can drop from the duct 13 and the companion element 42 assumes the second operating position, with the rear face 4*a* of the block 4 aligned substantially in the same plane as the first feed path Q (see FIG. 4).

Another function of the first feed means 19 is to ensure that the continuous strip 3 will continue to decoil from the roll when diverted by the block 4 and assume a profile substantially of "U" outline, hugging three faces of the block 4, namely the front face 4*b* and the two mutually parallel side faces 4*c* and 4*d*. More exactly, the side faces 4*c* and 4*d* lie respectively upstream and downstream in the direction F1 followed by the strip 3 along the first feed path Q.

With the block 4 occupying this position and the companion element 42 at a standstill, the first reaction arms 49 of the compacting device 48 assume their aforementioned first operating position of contact with the block 4, each rotating about the relative axis D from the at-rest position outside the dimensional compass of the channel 18, to a position in which the respective flat surface 49*a* lies parallel to the first feed path Q and breasted with the rear face 4*a* of the block 4.

The operating position thus described is shown in FIG. 4, where it will be seen that the first arms 49 oppose and prevent any movement of the block 4 of bundles 6 toward the top end of the channel 18, i.e. in the direction opposite to the direction F2 followed along the second path R.

The companion element 42 ceases movement in the normal feed direction F2, whereupon the direction of rotation of the motor 45*a* is reversed and the members 43, functioning as the second arm of the compacting device 48, begin applying a compressive force to the block 4 which in turn is prevented from moving upward by the flat surfaces 49*a* of the reaction arms 49.

The block 4 of bundles 6 is thus compacted by the compressive force, which will be varied according to whether the banknotes 5 being processed are new or soiled; more exactly, soiled banknotes tend to exhibit more irregularities precisely by reason of their prolonged use, so that the distance covered by the companion element 42 when compacting soiled banknotes, indicated schematically by phantom lines in FIG. 4, will be greater than when compacting new notes.

When the block 4 has been compressed to a certain degree, the compacting device 48 will remain in place to maintain the compacted condition.

The machine further comprises a bending device 55 located in the vicinity of the banding station 11, by which the leading portion 34 of the strip 3 is flattened against the rear face 4*a* of the block 4. The device 55 in question is provided by the two jaws 35 and 36 of the gripper device 33, which are caused to rotate together as one about the common axis C once the leading portion 34 of the strip 3 has been gripped firmly between them.

Figure 5:
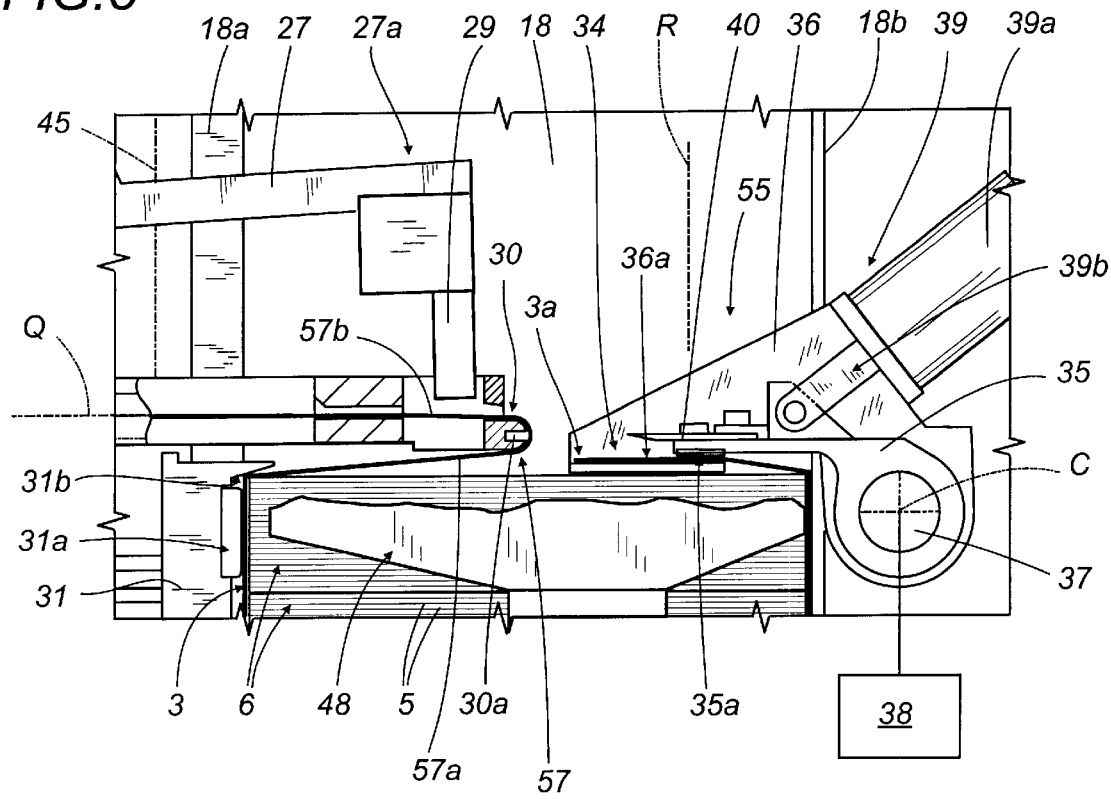

When performing the function of bending device 55 therefore, the two jaws 35 and 36 are rotated as one by the motor 38 about the relative axis C in such a manner that the leading portion 34 of the strip 3 is bent over and flattened against the rear face 4*a* of the block 4, as illustrated in FIG. 5.

In this situation the thin plate constituting the flat surface 36*a* of the second jaw 36 is interposed between the strip 3 and the rear face 4*a* of the block 4. The strip 3 is thus pinned against the second jaw 36 by the gripping action of the first jaw 35, of which the flat surface 35*a* overlaps the flat surface 36*a* of the second jaw 36 only in part. The non-overlapping area left by the jaws 35 and 36 is positioned to accommodate a sealable overlapping portion 56 of the strip 3 coinciding with the ends of the band 2, as will shortly be described.

The function of the clamp element 31, positioned immediately beyond the diverter element 30 in the direction F2 followed along the second feed path R and capable also of movement parallel to the first feed path Q, is to pin the strip 3 against the side face 4*c* of the block 4 of banknotes 5. To this end, the clamp element 31 is mounted translatably to the first slide 20, connected dynamically by way of a spring 32 such as will transmit the movement of the slide 20 to the element 31 and extend deformably as the element 31 locates against the side face 4*c* and the slide 20 continues its movement along the first path Q.

As the slide advances in the direction F1 of the first feed path Q, in effect, the clamp element 31 is urged against the block 4 in such a way that the contact surface 31a restrains the strip 3 breasted with the side face 4*c*, and the lip 31*b* engages the corner edge along which the side face 4*c* meets the rear face 4*a*.

As intimated above and shown clearly in FIG. 5, the first slide 20 continues to advance along the first feed path Q after the clamp element 31 has come to a stop against the block 4. In the course of this same movement, the strip 3 is engaged by the diverter element 30 associated with the end 20*a* of the slide 20 nearer the channel 18 and, wrapping around the element 30, caused to form a loop 57 of which a first branch 57*a* is breasted with the rear face 4*a* of the block 4, partly overlapping the leading portion 34 of the selfsame strip 3, and a second branch 57*b* extending substantially parallel with the first remains connected to the roll.

As mentioned previously, the slot 30*a* afforded by the diverter element 30 is disposed substantially parallel to the axis C of rotation of the gripper element 33 and shaped so as to accommodate part of the knife 40 associated with the first jaw 35.

As discernible from FIG. 6, the forward motion of the first slide 20 terminates when the knife 40 enters the slot 30*a*, striking against one edge and making a scissor cut through the strip 3 at the point where the loop 57 is formed.

The effect of cutting the continuous strip 3 is to separate a discrete length 58 that provides the band 2.

Figure 7:
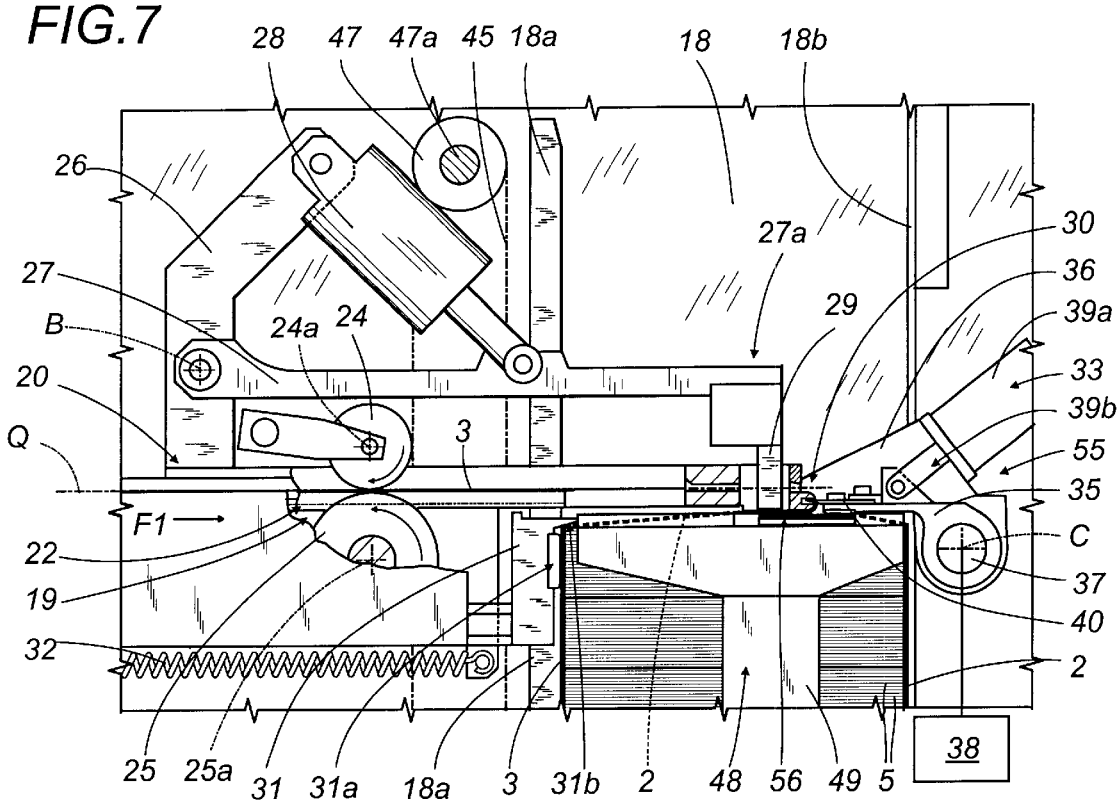

It will be seen from FIG. 6 that the rotation of the pinch rolls 24 and 25 is now inverted, as indicated by the arrows, thereby drawing the second branch 57*b* of the loop 57 away from the channel 18 through a distance such that when the arm 27 is lowered into the operating position, the heat seal bit 29 can enter into contact with the overlapping portion 56 of the discrete portion 58 and effect a join (see FIG. 7). The second branch 57*b* of the loop thus becomes the leading portion 34 of the strip 3 offered to the next block 4 of bundles 6, while the first branch 57*a* constitutes the trailing end 59 of the band 2 currently in place.

To reiterate, a portion of the trailing end 59 is placed over a portion of the leading portion 34 of the strip 3 to establish the overlapping portion 56 of the discrete length 58.

During the sealing step, as shown in FIG. 7, the flat surface 36*a* of the second jaw 36 remains squarely in contact with the rear face 4*a* of the block 4, providing a reaction element onto which the heat seal bit 29 can descend, and an insulating element by which the block 4 is protected from the heat generated through the bit 29.

The arm 27 remains permanently associated with the first slide 20 throughout all its movements along the first path Q, including the step of directing the strip 3 toward the gripper device 33, but will be lowered by the actuator 28 into the operating position only when the leading portion 34 of the strip 3 has been overlapped by the trailing end 59 of the discrete length 58 following the cut.

Figure 8:
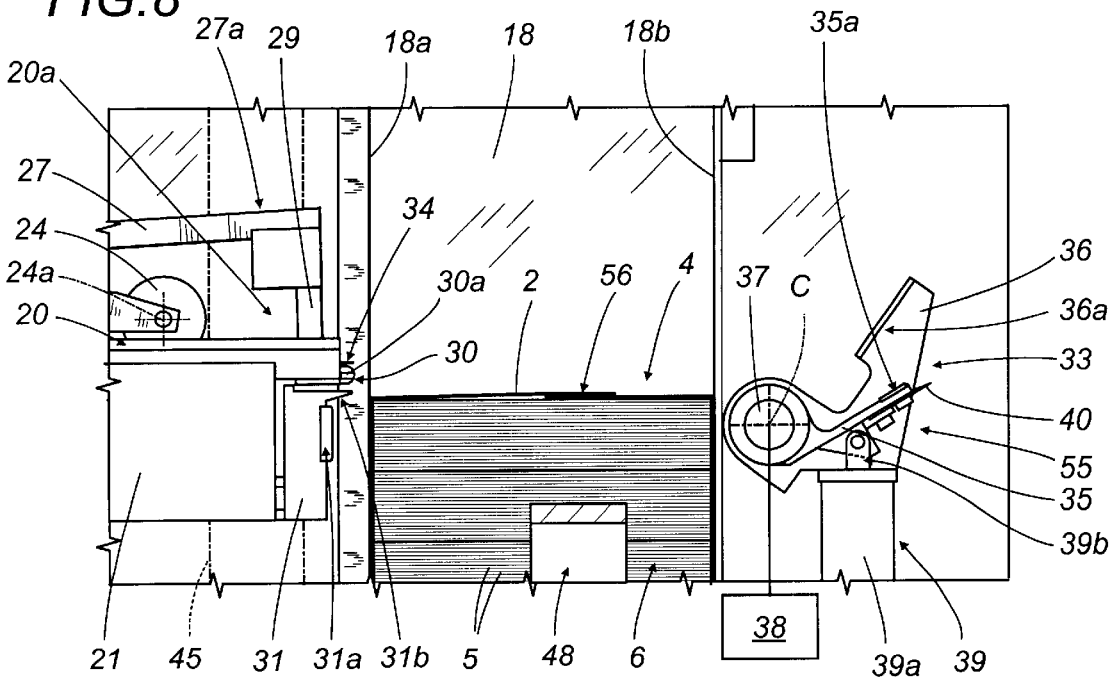

As discernible readily in FIG. 8, the slide 20 is retracted to a position remote from channel 10 once the strip 3 has been sealed, and with the knife 40 now free of the slot 30*a*, the first jaw 35 could be rotated clockwise so to return the flat surface 35*a* to the former position substantially tangential to the first feed path Q.

The second jaw 36 on the other hand is prevented from rotating as the relative flat surface 36*a* remains trapped between the sealed band 2 and the rear face 4*a* of the block 4. Accordingly, the grip between the jaws 35 and 36 is slackened initially by causing the one to rotate relative to the other through the agency of the actuator 39, whereupon the flat surface 36*a* is made to translate axially in the manner now to be described.

Observing FIG. 11, the shaft 37 supporting the jaws 35 and 36 is capable of axial motion produced by the actuator 52 and the bellcrank 53 which, to reiterate, is anchored to a fulcrum pivot 54 and coupled articulatedly to the shaft 37 on the one hand and the actuator 52 on the other.

The linear movement of the actuator 52 causes the bellcrank 53 to rotate about the fulcrum pivot 54 and thus translate the shaft 37. The two jaws 35 and 36 translate as one with the shaft 37 until the flat surface 36*a* of the second jaw 36 has cleared the band 2 completely, as indicated by the solid lines in FIG. 10, leaving the block 4 of notes free to proceed further along the second path R.

The shaft 37 is now rotated by the motor 38 in such a manner as to return the gripper device 33 to an angular position outside the dimensional compass of the channel 18, indicated by the phantom lines of FIG. 11. Thereafter, the shaft is translated in the opposite direction and the gripper device 33 thus repositioned axially in readiness to receive the strip 3, as illustrated by the solid lines in FIG. 11.

Figure 9:
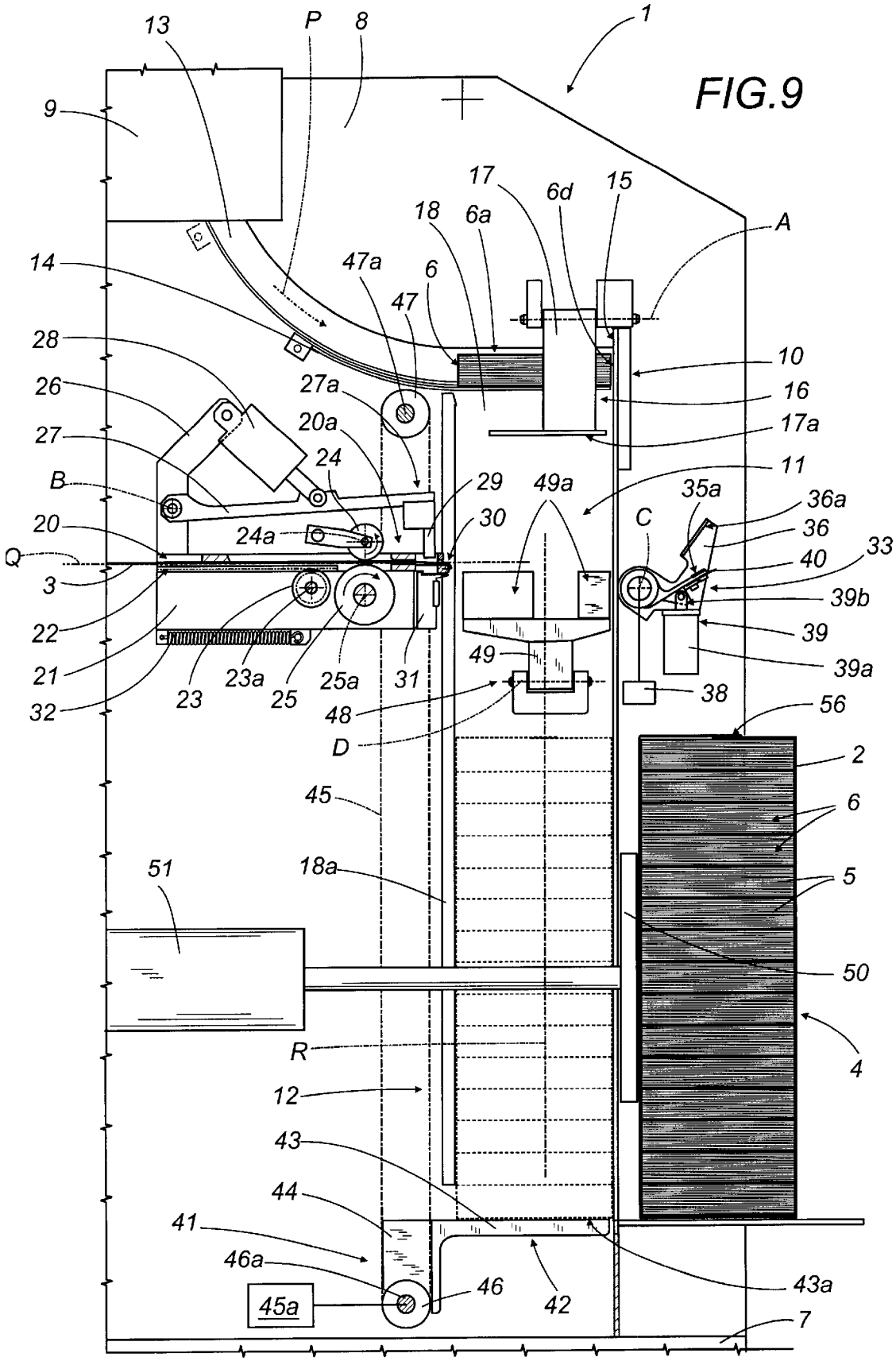

With reference to FIG. 9, the first reaction arms 49 are distanced from the operating position of contact with the block 4, rotating about the respective axes D to resume the at-rest position externally of the channel 18.

The block 4 of bundled banknotes 5 secured by the band 2 of strip material 3 is now free to advance with the companion element 42 as it continues along the second path R toward a discharge position at the outfeed station 12, where the push rod 50 is caused to extend by the corresponding actuator 51 and eject the block 4 from the channel 18.

The companion element 42 is then able to reascend (FIG. 1) toward the upper part of the channel 18 in readiness to receive more bundles 6 and begin forming another block 4.

Importantly, it will be seen that the machine in the embodiment disclosed can be used to apply more than one band 2 to each block 4, performing the same set of operations described and illustrated simply utilizing two strapping or banding units in parallel, as illustrated in FIG. 10. A unit in this context will include the full set of parts needed in accordance with the present invention to apply one band, namely the first feed means 19 for positioning the strip 3, the gripper device 33, the bending device 55, the knife 40 and the heat seal bit 29.

Figure 12:
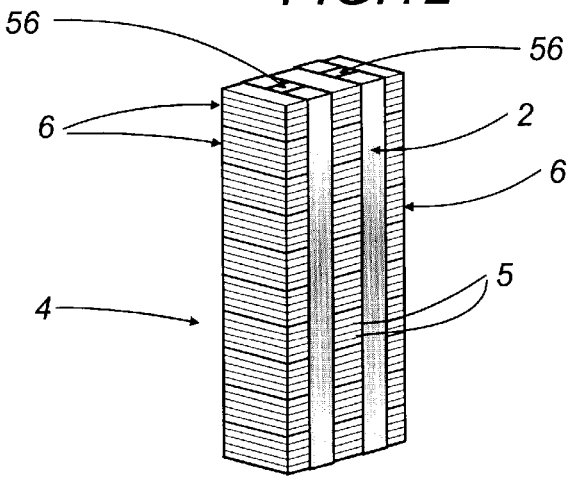
FIG. 12 illustrates a block of bundled banknotes banded by a machine as illustrated in FIGS. 1 to 11, viewed in perspective.

FIG. 12 illustrates a block 4 of bundles 6 secured by two parallel bands 2.

As alternatives to the solution described in the foregoing specification, the machine according to the present invention might be configured with the rectilinear second feed path R, and therefore the channel 18, positioned horizontally or obliquely; such arrangements might be adopted in order to meet space saving requirements dictated by the design of the currency processing system in which the machine disclosed is utilized.

What is claimed is:

1. A method for securing at least one band of strip material around a substantially parallelepiped block of sheets, in particular banknotes, comprising the steps of causing at least one continuous strip decoiling from a roll to advance along a first predetermined path, through the agency of first feed means; restraining one end of the continuous strip through an agency of gripping means designed to interact with a leading portion of the strip that coincides with a first end of the band; causing the block of sheets, through the agency of second feed means, to advance along a second path transversely to the first path in such a manner as to enter into contact with the strip and, continuing to advance along the second path, cause the strip to decoil further from the roll and bend to a "U" profile, compacting the block through the agency of relative compacting means, engaging the rear face of the block when in the operating position through the agency of movable reaction means, and causing the second feed means to move toward the reaction means, engaging the leading portion of the strip through an agency of bending means and flattening it against a face of a block; drawing the strip into overlapping contact with the first end of the band, through an agency of diverter means located on the side of the second path opposite to the bending means; cutting the strip at the overlap through the agency of cutter means, to define a second end of the band; securing the second end of the band to the first end through an agency of sealing means.

2. A method as in claim 1, wherein the step of drawing the strip into overlapping contact with the first end of the band through the agency of diverter means is implemented in such a way as will cause the strip to describe a loop of which a first branch is offered to the rear face of the block and to the first end of the band, and a second branch remains associated with the first feed means.

3. A method as in claim 2, comprising a further step, effected after the step of cutting the strip, in which the second branch of the loop is retracted and distanced from the second path through the agency of the first feed means.

4. A method as in claim 1, wherein the step of causing the block to advance along the second path is of duration sufficient at least to bring the rear face of the block into an operating position substantially occupying the same plane as that of the first path, and such also that the continuous strip is caused by the advancing block to assume the "U" profile by engaging three faces of the block identifiable as a front face opposite to the rear face and two mutually parallel side faces lying respectively upstream and downstream relative to a feed direction followed by the strip along the first path.

5. A method as in claim 1, comprising a further step, effected before the step of cutting the strip, in which the strip is pinned against the block of sheets through the agency of clamp means operating beyond the diverter means along the direction followed by the block along the second path.

6. A method as in claim 1, wherein the step of advancing the strip along the first path includes a step of propelling the leading portion of the strip to a position of proximity with the gripping means and a step of taking up the leading portion through the agency of the gripping means while occupying a position remote from the second path.

7. A method as in claim 6, wherein the strip is directed toward the gripping means during the propelling step by guide means.

8. A method as in claim 1, comprising the further step, effected after the sealing step, of shifting the bending means transversely to the first path in such a way as to disengage the selfsame bending means from the strip.

9. A method as in claim 1, wherein the second path is substantially vertical.

10. A method as in claim 1, wherein the second path is substantially horizontal.

11. A machine for securing at least one band of strip material around a substantially parallelepiped block of sheets, in particular banknotes, comprising first feed means by which at least one continuous strip decoiling from a roll is caused to advance along a first predetermined path in a predetermined direction; a channel serving to guide a block of sheets and establishing a second predetermined path transverse to the first path; gripping means positioned external to the channel and in such a manner as to interact with a leading portion of the continuous strip and restrain one end of the selfsame strip, the leading portion of the strip coinciding with a first end of the band; second feed means by which a block of sheets is caused to advance along the channel and enter into contact with the strip; bending means operating in conjunction with the gripping means, by which the leading portion of the strip is flattened against a face of the block positioned; diverter means located on the side of the channel opposite to the bending means, by which the strip is engaged and drawn into the overlapping contact with at least a part of the leading portion; cutter means by which the strip is severed at the overlap to define a second end of the band; sealing means by which the second end of the band is secured to the first end, wherein the second feed means comprise at least one companion element affording a platform serving to support the block and capable of reciprocating movement along the second path, and further comprising means by which to compact the block, consisting in at least one first reaction arm presenting a relative surface offered in contact to the rear face of the block and capable of movement between a first operating position and a second at-rest position, also a second compacting arm afforded by the at least one companion element.

12. A machine as in claim 11, wherein the strip is engaged by the diverter means and caused to describe a loop of which a first branch is offered to the rear face of the block and to the initial portion of the strip, and a second branch remains associated with the first feed means.

13. A machine as in claim 11, comprising guide means capable of movement along the first path and serving to direct the leading portion of the strip toward the gripping means.

14. A machine as in claim 13, wherein the guide means present one end directed toward the channel and constituting the diverter means.

15. A machine as in claim 11, wherein the gripping means are of prehensile embodiment, comprising a first jaw and a second jaw.

16. A machine as in claim 15, comprising means by which to induce relative movement of the jaws between a first position in which the two jaws are open and able to admit the strip, and a second position in which the jaws are closed with the strip gripped between them.

17. A machine as in claim 15, wherein the second jaw presents a flat surface which when breasted in contact with the block serves as a reaction element for the sealing means.

18. A machine as in claim 15, wherein at least the first jaw or the second jaw is pivotable about an axis extending substantially transverse to the first path.

19. A machine as in claim 18, wherein the jaws are one and the same as the bending means, and consequently rotatable as one about the relative axis through the agency of drive means.

20. A machine as in claim 11, further comprising actuator means by which the bending means are shifted transversely to the first path to the end of disengaging the selfsame bending means from the strip.

21. A machine as in claim 20, wherein the actuator means and the drive means combine to move the bending means through three successive positions comprising a first limit position of engagement with the strip, an intermediate second position of disengagement from the strip assumed by translating the bending means transversely to the first path along a first direction, and a third limit position of readiness to take up the strip, assumed by translating the bending means in a direction opposite to the first direction.

22. A machine as in claim 11, comprising clamp means operating at a level below the diverter means, of which the function is to pin the strip against the block.

23. A machine as in claim 11, comprising recoil means serving to distance the second branch of the loop from the second path.

24. A machine as in claim 11, wherein the diverter means present a slot extending transversely to the first path and positioned to interact with the cutting means when making the cut through the strip.

* * * * *